US006896176B1

(12) United States Patent
Stinson

(10) Patent No.: US 6,896,176 B1
(45) Date of Patent: May 24, 2005

(54) CRIME-DETERRENT MAILBOX INDICATOR ASSEMBLY

(76) Inventor: Jerry J. Stinson, 3088 Ragsdale Dr., Milan, TN (US) 38358

( * ) Notice: Subject to any disclaimer, the term of this patent is extended or adjusted under 35 U.S.C. 154(b) by 21 days.

(21) Appl. No.: 10/663,408

(22) Filed: Sep. 16, 2003

Related U.S. Application Data

(60) Provisional application No. 60/412,862, filed on Sep. 23, 2002.

(51) Int. Cl.[7] ..... B65D 91/00
(52) U.S. Cl. ..... 232/35
(58) Field of Search ..... 232/35, 34, 17

(56) References Cited

U.S. PATENT DOCUMENTS 3,482,543 A * 12/1969 Guidos ..... 232/35
4,065,050 A * 12/1977 Hunt ..... 232/34
5,076,337 A * 12/1991 Reuter ..... 160/35
5,123,590 A * 6/1992 Teele ..... 232/35
5,366,148 A * 11/1994 Schreckengost ..... 232/35
5,816,489 A * 10/1998 Stockman ..... 232/35
5,964,401 A * 10/1999 Thill ..... 232/35
6,575,357 B1 * 6/2003 Rundell ..... 232/35

* cited by examiner

*Primary Examiner*—William L. Miller
(74) *Attorney, Agent, or Firm*—Smith, Gambrell & Russell, LLP

(57) ABSTRACT

A crime-deterrent mailbox indicator assembly for providing notification to a user of the presence of materials in a mailbox includes a display member that is connected to the mailbox using a resilient member, a notification latch affixed to the door of the mail, and a locking attachment affixed to the side of the mailbox. The display member will be in an upright position not engaging either the notification latch or the locking attachment, thus indicating that materials are present in the mailbox. When the display member engages the notification latch, the display member will remain deflected and hidden until the door is opened, at which time the display member will return to the upright position. When the display member engages the locking attachment, the display member will be deflected and hidden from sight, and further prevented from returning to the upright position, thereby preventing the undesired effect of notifying others of the absence of the user.

20 Claims, 4 Drawing Sheets

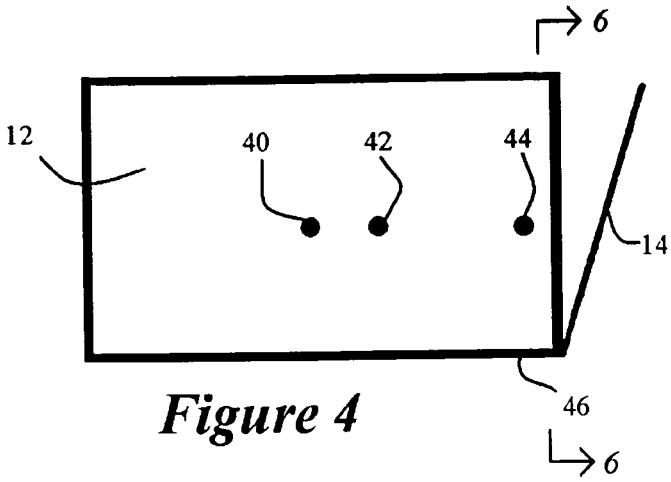
Figure 4
Figure 5
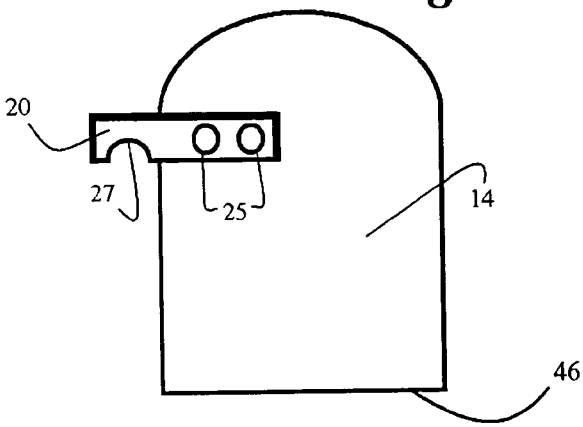
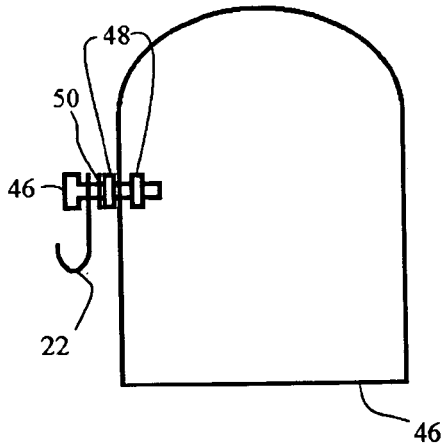
Figure 6

CRIME-DETERRENT MAILBOX INDICATOR ASSEMBLY

CROSS-REFERENCE TO RELATED APPLICATIONS

This utility patent application claims benefit of U.S. Provisional Patent Application No. 60/412,862, filed Sep. 23, 2002, entitled "Crime-Deterrent Mailbox Indicator Assembly," which application is incorporated herein by reference.

FIELD OF THE INVENTION

The present invention relates generally to the field of mailbox accessories. More specifically, the present invention relates to a visual indicator assembly affixed to a mailbox that signals a person when mail is in their mailbox. Even more specifically, the present invention relates to a visual indicator assembly that is easily disabled for safety purposes for the user and deterring crime.

BACKGROUND OF THE INVENTION

In areas where houses are spaced far apart and set back from the street, such as rural areas, homeowners ordinarily have mailboxes that are likewise substantially far from the house. When the mailbox is substantially distant from the house, it is difficult for the homeowner to determine whether or not the mail has arrived, apart from actually seeing the mail carrier deposit the mail in the mailbox or by actually walking a long distance to check the mailbox. Neither of these methods is very practical or time efficient for the homeowner. Moreover, checking an empty mailbox is an annoying occurrence for the homeowner.

As a result, homeowners have attempted to develop ways to notify the homeowner that mail has been deposited in the mailbox. One such attempt has been to incorporate a visual signal on the mail box that notifies the homeowner when the mailbox lid has been opened. In one example, a resilient member is attached to the mailbox that is positioned between a substantially horizontal position when the mailbox door is closed and a substantially vertical position when the mailbox door has been opened. One problem with such a design, as addressed in U.S. Pat. No. 5,816,489 to Stockman, has been inadequate safety measures for the mail carrier and users of the box. That is, the resilient member may quickly into an upright position when the mailbox lid is opened, thereby harming the mail carrier or other person opening the mailbox. To address this problem, Stockman discloses the use of a visual indicator attached to the resilient elongated member, with a tip protector further attached to the visual indicator.

While Stockman provides a safety device to the person opening the mailbox of the visual indicator by adding the tip protector, there remains a problem with prior visual indicators used on mailboxes. In particular, a drawback with such designs is that they do not include a means for easily disabling the indicator by the homeowner. As a result, an indicator that remains up for a period of time, such as an overnight period up to an extended period of days, will signify to potential burglars and other criminals that the homeowner is not present and therefore is not available to foil an attempted crime.

What is desired, then, and not found in the prior art, is a safe mailbox indicator that provides notice to the homeowner of receipt of mail and that also is hidden to conceal when the homeowner's absence from the home.

SUMMARY OF THE INVENTION

The crime-deterrent mailbox indicator assembly of the present invention is attached to a conventional mailbox to provide notification to a user of the presence of materials in the mailbox. The assembly includes a display member that is connected to the mailbox using a resilient member. The display member in the preferred embodiment is a lightweight rod that can easily be moved by a user, and it is attached to the resilient member that is preferably a conventional spring or coil that is able to easily bend as directed by a user and then recoil to the original position when no force is applied. The mailbox indicator assembly additionally includes a notification latch that is attached to the front door of the mailbox and a locking attachment affixed to the side of the mailbox, which are each used as latches to engage the display member.

The display member will be in an upright and relaxed position when the display member does not engage either the notification latch or the locking attachment, thus indicating that materials are present in the mailbox. When the display member engages the notification latch, the display member will be deflected and substantially hidden until the door is opened, at which time the display member will return to the relaxed, upright position. Finally, when the display member engages the locking attachment, the display member will be indefinitely blocked from returning to the upright position, thereby preventing the undesired effect of notifying strangers and potential criminals of the absence of the user.

These and other objects and advantages of the invention will become apparent from the following detailed description of the preferred embodiment of the invention.

BRIEF DESCRIPTION OF THE DRAWING

A crime-deterrent mailbox indicator assembly embodying the features of the present invention is depicted in the accompanying drawing which form a portion of this disclosure and wherein:

FIG. 4 is a side elevational view of the mailbox showing the position of mailbox indicator;

FIG. 5 is a front elevational view of the door to the mailbox, with the indicator hook bracket attached thereto; and FIG. 6 is a sectional view of the mailbox illustrating one embodiment for mounting the security member to the mailbox.

DESCRIPTION OF THE PREFERRED EMBODIMENT

Looking now to FIGS. 1 through 6, the mailbox indicator assembly 10 of the present invention is illustrated. The mailbox indicator assembly 10 is attached to a conventional mailbox 12 having a front door 14 pivotally attached thereto.

The purpose of the mailbox indicator assembly 10 is to provide notice to the user that the front door 14 of the mailbox 12 has been opened, with the associated implication being that mail and other materials have been placed in the mailbox 12. As a result, the user will know from a location remote from the mailbox 12, such as the user's house, that the mailbox 12 has mail to be collected. Such a design prevents the user from making unnecessary trips to the mailbox 12 only to learn that no materials have been placed in the mailbox 12.

Figure 1:
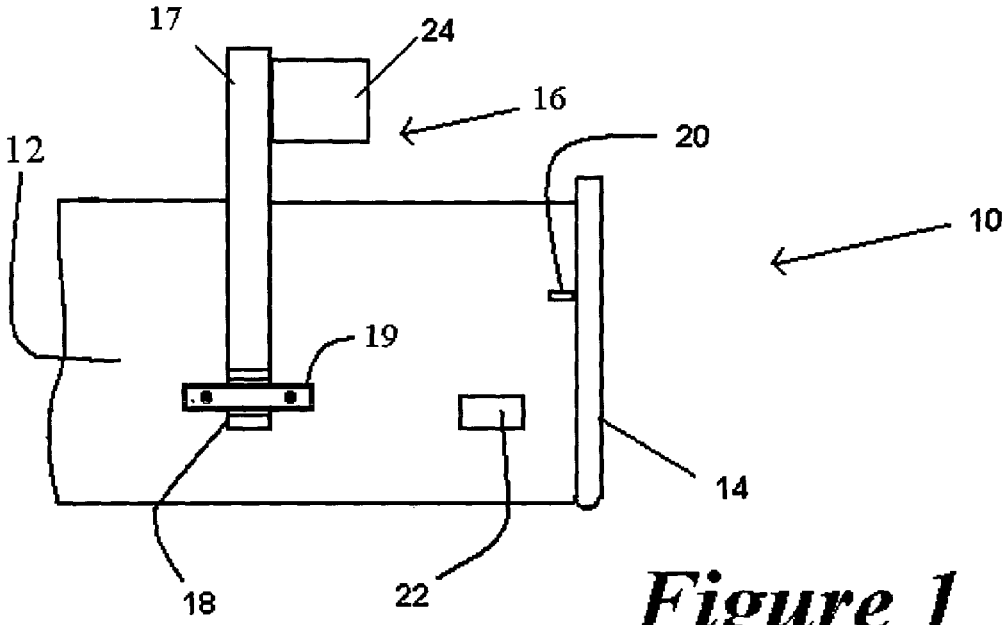
FIG. 1 is a side elevational view of the mailbox indicator assembly of the present invention, with the mailbox indicator assembly being in a relaxed position.

Continuing to view FIG. 1, the mailbox indicator assembly 10 includes a display member 16 that is connected to the mailbox 12 using a resilient member 18. The display member 16 in one embodiment of the invention is a lightweight rod 17, comprised of plastic or a lightweight metal, that can easily be moved by a user. The display member 16 may include a flag 24 or other means to aid in notifying observers of the presence of materials in the mailbox 12. The resilient member 18 is preferably a conventional spring or coil that is able to easily bend as directed by a user and then recoil to the original position when no force is applied. The resilient member 18 may be affixed to the mailbox 12 in a number of ways, including a bracket 19 as illustrated in FIG. 1. Consequently, the display member 16 will be in an upright position as shown in FIG. 1 when no pressure or barrier prevents the display member 16 from being in the upright, substantially vertical position.

In addition to the display member 16, the mailbox indicator assembly 10 includes two securing members to lock the display member 16 in a temporary locking position and a constant locking position. More specifically, one such securing member is a notification latch 20 that is attached to the front door 14 of the mailbox 12. The second is a locking attachment 22 affixed to the side of the mailbox 12. Both the notification latch 20 and the locking attachment 22 are used to bend and deflect and substantially hide the display member 16 proximate the mailbox 12, as discussed further herein.

Figure 2:
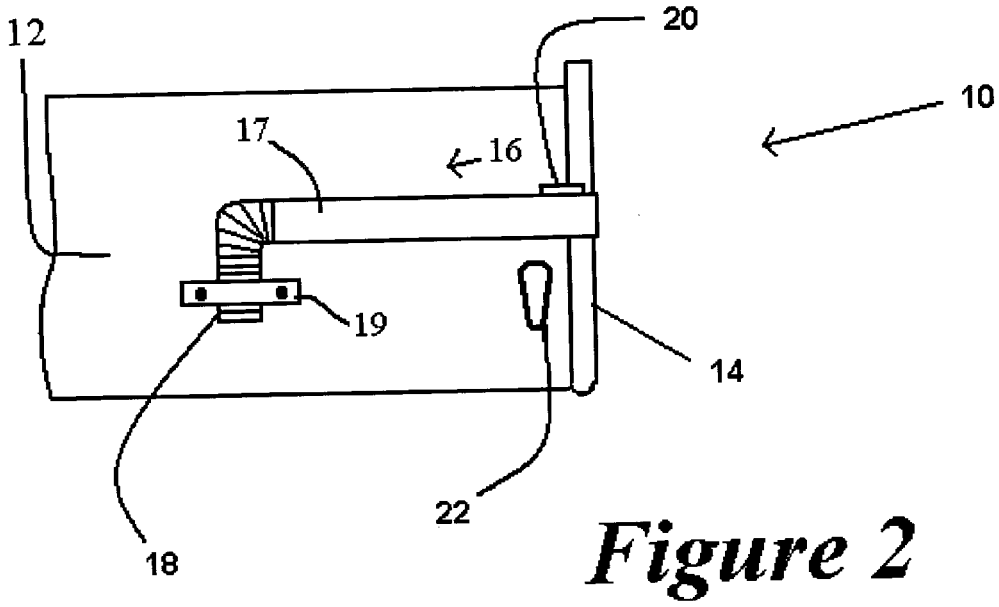
FIG. 2 is a side elevational view of the mailbox indicator assembly of the present invention, with the mailbox indicator assembly being in a temporarily detained position.
Figure 3:
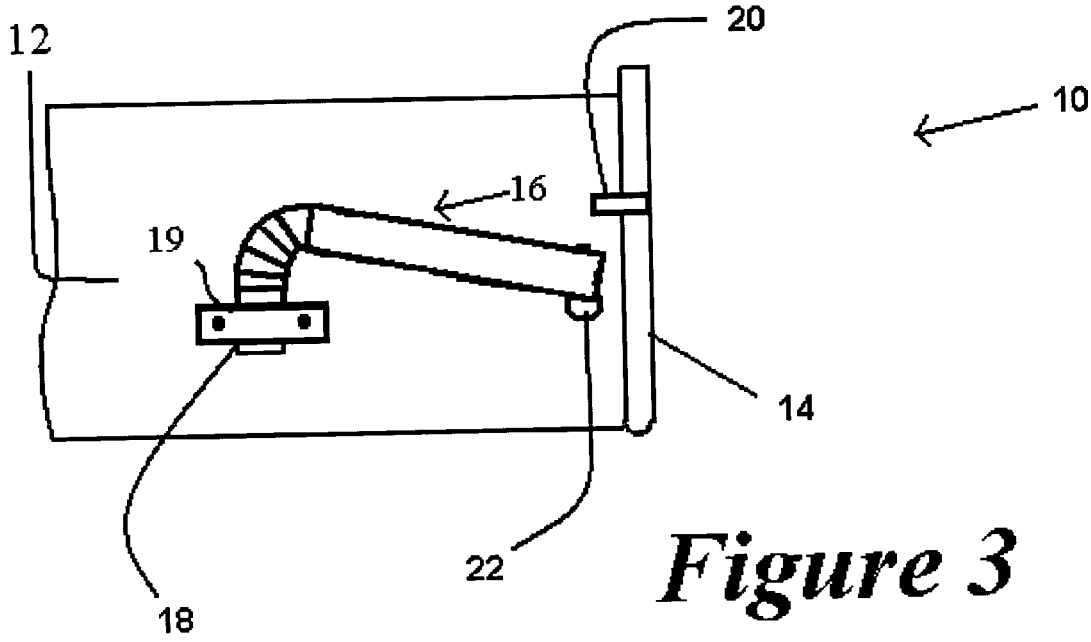
FIG. 3 is a side elevational view of the mailbox indicator assembly of the present invention, with the mailbox indicator assembly being in a locked position.

Comparing FIGS. 1 through 3, the mailbox indicator assembly 10 is in one of three positions during normal operation. That is, the display member 16 is one of the following positions: a display position, in which the display member 16 is substantially vertical with the resilient member 18 being in a relaxed, straightened position (as shown in FIG. 1); a detained position, in which the display member 16 is substantially horizontal in a temporarily held position in contact with the notification latch 20 (as shown in FIG. 2); or a locked position, in which the display member 16 is substantially horizontal in a continuously secured position in contact with the locking attachment 22 (as shown in FIG. 3).

The notification latch 20 is typically a bracket, small bar, or similar element, and the user will move the display member 16 to contact the notification latch 20 as shown in FIG. 2 when the user is awaiting the receipt of materials in the mailbox 12. Once the door 14 is opened, the notification latch 20 will no longer contact the display member 16. Consequently, the display member 16 will return to the relaxed position, thereby providing notification to the user and any other observer that the materials should be in the mailbox 12. Once the user has removed the materials from the mailbox 12, the display member 16 will be reset the detained position to engage the notification latch 20 and wait for the next time that the door 14 is opened.

While the design discussed thus far provides an excellent means for notifying the user that the door 14 has been opened and therefore it is likely that materials are present in the mailbox 12, the design also provides notice to all observers whether the user has retrieved the materials from the mailbox 12. More importantly, if the display member 16 remains in the relaxed position as illustrated in FIG. 1, then it provides a clear notice to all observers that the owner is not at home to retrieve the materials. Thus, this further provides a notice to potential criminals that the user's home is not occupied, and therefore the criminal would have the best opportunity for a successful heist.

To address this problem and to deter such criminal activity, the mailbox indicator assembly 10 additionally includes the locking attachment 22 attached to the mailbox 12. The locking attachment 22 may be a hook, tab, or other protrusion that is positioned proximate the door 14 and lower than the notification latch 20 (see FIG. 1). In the embodiment illustrated in FIG. 6, the locking attachment 22 is a hook pivotally secured to one side of the mailbox 12.

Looking to FIG. 3, the user can move the display member 16 into a locked position by positioning the display member 16 in contact beneath the locking attachment 22. As a result, the display member 16 will remain in the locked position indefinitely, undisturbed by the movement of the door 14. Since the display member 16 remains in the locked position, observers are not blatantly notified that the user has not examined the mailbox 12 for its contents, and therefore observers are not alerted to the absence of the users. Thus, by easily locking and disabling the display member 16, the user is able to continue to receive mail while avoiding the notification of criminals that the user is away from the house by the display member 16 being continuously upright.

Finally, it is simple for the user to unlock the display member 16 to return the mailbox indicator assembly 10 to normal operation. The user simply moves the display member 16 to engage the notification latch 20 rather than the locking attachment 22, and the display member 16 will once again notify the user when the door 14 is opened.

The method for affixing the mailbox indicator assembly 10 to the mailbox 12 is illustrated in FIGS. 4 through 6. Looking to FIG. 4, three holes 40, 42, and 44 are drilled into one side of the mailbox 12. Preferably the holes are 4.25 inches above the base 46 of the mailbox 12. The first hole 40 is approximately 8.5 inches from the opening of the mailbox 12, and the second hole 42 is approximately one inch from the first hole 40. The third hole 44 is positioned in a horizontal line with first and second holes 40, 42, and is approximately one inch from the opening of the mailbox 12. The spring 18 is mounted to the wall of the mailbox 12 using the first and second holes 40, 42 and two nuts and two screws (not illustrated).

The locking attachment 22 or hook is next mounted to the wall of the mailbox 12 using a screw 46, two nuts 48, and a washer 50 (see FIG. 6). The locking attachment 22 will swing downwardly when not engaging the display member 16 such that the locking attachment 22 will not be in the way of operation of the display member 16. However, when the user wishes to secure the position of the display member 16, the user will rotate the locking attachment 22 approximately 180 degrees, and the display member 16 will be pulled by the user to engage the arched portion of the locking attachment 22. This position is used only when the user does not want the display member 16 to stand upright as the door 14 is opened. Moreover, the engagement of the locking attachment 22 by the display member 16 will determinedly secure the position of the display member 16.

When the user decides to once again use the display member 16, the user will simply disengage the display member 16 from the locking attachment 22. The locking attachment 22 will concurrently rotate back to a lowered position that prevents that locking attachment 22 from easily encountering the display member 16 during operation. Consequently, the locking attachment 22 will not rotate back into an interfering position until desired by the user.

Thus, although there have been described particular embodiments of the present invention of a new and useful CRIME-DETERRENT MAILBOX INDICATOR ASSEMBLY, it is not intended that such references be construed as limitations upon the scope of this invention except as set forth in the following claims.

What is claimed is:

1. A mailbox indicator assembly attached to a mailbox having a pivotal door attached thereto, the pivotal door moving between an opened position and a closed position said mailbox indicator assembly comprising:

a display member connected to the mailbox wherein said display member is movable between a substantially upright position and a substantially bent position;

a notification latch fastened to the door, said notification latch positioned to engage said display member when the door abuts the mailbox; and a locking attachment affixed to the mailbox to restrain said display member when the pivotal door is in both the open position and the closed position.

2. The mailbox indicator assembly as described in claim 1 wherein said display member comprises:

a rod; and a resilient member connected to the mailbox.

3. The mailbox indicator assembly as described in claim 2 wherein said resilient member comprises a spring.

4. The mailbox indicator assembly as described in claim 1 wherein said notification latch comprises a bracket.

5. The mailbox indicator assembly as described in claim 1 wherein said locking attachment comprises a bar affixed to the mailbox.

6. The mailbox indicator assembly as described in claim 1 wherein said locking attachment comprises a hook pivotally affixed to the mailbox.

7. The mailbox indicator assembly as described in claim 1 wherein said display member engages said locking attachment indefinitely.

8. A mail indicator assembly affixed to a mailbox having an opening and a pivotal door pivotally attached proximate the opening the pivotal door moving between a position abutting the opening of the mailbox and a position disengaged from the opening of the mailbox, said mailbox indicator assembly comprising:

a display member connected to the mailbox wherein said display member is movable between a substantially upright position and a substantially bent position;

a notification latch attached to the door to engage said display member when the door is in the position abutting the mailbox opening; and a locking attachment connected to the mailbox, said locking attachment positioned to lock said display member in a restrained position when the door is in both the position abutting the mailbox opening and the position disengaged from the mailbox opening.

9. The mailbox indicator assembly as described in claim 8 wherein said display member comprises:

a rod; and a resilient member connected to said mailbox.

10. The mailbox indicator assembly as described in claim 9 wherein said resilient member comprises a spring.

11. The mailbox indicator assembly as described in claim 8 wherein said notification latch comprises a bracket.

12. The mailbox indicator assembly as described in claim 8 wherein said locking attachment comprises a bar affixed to the mailbox.

13. The mailbox indicator assembly as described in claim 8 wherein said locking attachment comprises a hook pivotally affixed to the mailbox.

14. A mailbox indicator assembly attached to a mailbox having a door pivotally attached to a mailbox housing, said mailbox indicator assembly comprising:

display means for notifying a user of the door being pivoted from the mailbox housing, said display means being flexible between a substantially upright position and a substantially bent position;

temporary locking means for displacing said display means, said temporary locking means affixed to the door to provisionally shift said display means into the bent position while the door is proximate the housing; and constant locking means for displacing said display means, said constant locking means affixed to housing to shift said display means into the bent position.

15. The mailbox indicator assembly as described in claim 14 wherein said display means comprises:

a rod; and a resilient member connected to the mailbox.

16. The mailbox indicator assembly as described in claim 15 wherein said resilient member comprises a spring.

17. The mailbox indicator assembly as described in claim 14 wherein said temporary locking means comprises a notification latch.

18. The mailbox indicator assembly as described in claim 14 wherein said constant locking means comprises a bracket affixed to the mailbox.

19. The mailbox indicator assembly as described in claim 14 wherein said constant locking means comprises a hook pivotally affixed to the mailbox.

20. The mailbox indicator assembly as described in claim 14 wherein said display means engages said constant locking means indefinitely.

* * * * *